US005947488A

United States Patent [19]

Gorza et al.

[11] Patent Number: 5,947,488

[45] Date of Patent: Sep. 7, 1999

[54] ANGULAR ADJUSTMENT DEVICE, PARTICULARLY FOR A SNOWBOARD BINDING

[75] Inventors: Roberto Gorza, Feltre; Luca Bertolo, Treville Di Castelfranco Veneto, both of Italy

[73] Assignee: Nordica S.p.A., Trevignano, Italy

[21] Appl. No.: 08/885,962

[22] Filed: Jun. 30, 1997

[30] Foreign Application Priority Data

Jul. 5, 1996 [IT] Italy ..... TV96A0087

[51] Int. Cl.[6] ..... A63C 9/081

[52] U.S. Cl. ..... 280/14.2; 280/607

[58] Field of Search ..... 280/14.2, 613, 280/617, 618, 629, 630, 634, 607

[56] References Cited

U.S. PATENT DOCUMENTS

| | | | |
|---|---|---|---|
| 5,354,088 | 10/1994 | Vetter et al. | 280/618 |
| 5,499,837 | 3/1996 | Hale et al. | 280/618 |
| 5,553,883 | 9/1996 | Erb | 280/607 |
| 5,577,755 | 11/1996 | Metzger et al. | 280/607 |
| 5,586,779 | 12/1996 | Dawes et al. | 280/14.2 |
| 5,667,237 | 9/1997 | Lauer | 280/607 |
| 5,732,959 | 3/1998 | Soejima | 280/14.2 |
| 5,782,476 | 7/1998 | Fardie | 280/14.2 |
| 5,820,155 | 10/1998 | Brisco | 280/607 |

FOREIGN PATENT DOCUMENTS 2 627 097 8/1989 France .

*Primary Examiner*—Robert J. Oberleitner
*Assistant Examiner*—Daniel Yeagley
*Attorney, Agent, or Firm*—Guido Modiano; Albert Josif

[57] ABSTRACT

An angular adjustment device, particularly for a snowboard binding to which a disk is rigidly coupled and comprises a supporting base for a shoe. The device is constituted by first engagement elements, associated with the base, which selectively interact, through second release elements which can be operated by the user, with third coupling elements which are rigidly coupled to the disk.

13 Claims, 4 Drawing Sheets

ANGULAR ADJUSTMENT DEVICE, PARTICULARLY FOR A SNOWBOARD BINDING

BACKGROUND OF THE INVENTION

The present invention relates to an adjustment device, particularly for a snowboard binding.

Snowboarding is characterized by various techniques which can be used by the skier, including jumps and various acrobatic maneuvers, slalom, and speed; of course, in order to correctly perform each one of these techniques, the user must assume a body posture which has a given angle with respect to the longitudinal axis of the board.

U.S. Pat. No. 5,028,068 discloses a device for selectively and pivotally positioning a ski binding on a snowboard.

This patent substantially illustrates a first plate which supports the boot and is arranged above a second circular plate which is perimetrically provided with a groove.

The second circular plate is rotatably connected to a third plate, which is in turn rigidly connected to the board. The second circular plate has, at the groove, a cable which is wound thereat and can be tensioned by means of a lever.

Actuation of the lever allows the engagement and/or disengagement of the cable with respect to the second circular plate, allowing the user to vary the angular position of the binding with respect to the longitudinal axis of the board.

This solution, however, has drawbacks: during slalom, jumping and acrobatic maneuvers, the binding and therefore the board are subjected to many torsional stresses which may not be effectively contrasted by the tension of the cable on the second circular plate. In particular, upon impact with the snow after a jump, the binding is subjected to a sudden and very intense torsional stress which can hardly be contrasted by the friction between the two smooth surfaces of the first and second plates.

Moreover, the lever for tensioning the cable is spaced and separate from the binding: the lever can therefore easily disengage during sports practice because of accidental impacts thereof against rocks or other objects or because of the snow.

Furthermore, part of the cable is exposed to possible accidental impacts and can be torn or be weakened, thus compromising use of the binding.

The user, in such cases, would lose control of the board, which would be difficult to steer; snow or water can also deposit between the cable and the second circular plate, further decreasing the friction between the two smooth surfaces of the first and second plates and accordingly decreasing the overall locking force of the lever.

All this has a negative effect on the user who, because of the possible lack of rigid engagement between the binding and the board, might suffer severe problems to the legs in case of a fall.

U.S. Pat. No. 5,044,654 discloses a binding for performing winter sports which can be subjected to a rotation about its own vertical axis; six appropriately spaced holes are thus formed thereon to accommodate an equal number of screws which allow to fix it to the board in a chosen angular position which is selected by the user. The angular position can be changed by unscrewing the screws and repositioning them so that the binding is rotated through the intended angle.

The binding also has a safety for the quick release of the boot from the board, which is substantially composed of a hub on the perimeter of which appropriately shaped seats are provided for accommodating a ball with a forced-fit action produced by a spring.

This solution, however, has drawbacks; in order to vary the angular position of the binding with respect to the snowboard, the user must remove his foot from the binding and, by means of an adapted tool, unscrew the fixing screws, reposition the binding in the intended position, and reconnect the binding to the board.

The above-described operations, however, require considerable time, forcing the user to always have at least one tool available.

Moreover, in order to perform the adjustment, the user must remove his foot from the binding, and accordingly he or she does not have an immediate perception of the adjustment performed.

Owing to the limited attention which the user devotes to these operations because of his eagerness to be on the skiing slopes, the screws might also be fixed imprecisely to the board, with a consequent danger of disconnection or poor steerability of the board during sports practice.

It is also known to use a snowboard binding which is fixed to the board by means of a disk which is rigidly connected to the board by screws.

Perimetrically arranged inclined planes protrude towards the board, below the disk, and interact with complementarily shaped planes formed at an adapted disk containment seat formed on the binding.

By tensioning the screws appropriately, the disk moves towards the board until its inclined planes interact with the complementarily shaped planes formed on the binding, thus locking the disk and the binding to the board in a chosen position.

It is known to replace the inclined planes with pairs of sets of teeth which are likewise inclined and are located on the disk and on the binding.

In this manner, the engagement and disengagement of the screws allows the disk to rise until the pairs of sets of teeth are mutually disengaged, although the disk remains coupled to the board.

By rising, the disk allows to rotate the binding, which can be arranged in the chosen angular position.

It is thus possible to obtain a range of mutually different positions whose number, however, is limited by the size of the teeth that constitute the pairs of sets of teeth.

Use of such a conventional binding, however, entails other drawbacks: the user must remove his or her gloves, remove his or her foot from the binding, have a screwdriver or a suitable wrench to disengage the screws, turn the binding with his hands into the position which is close to the intended one, and tighten the entire assembly.

This operation is excessively long and troublesome to perform directly on the ski-run in order to modify the angular position according to specific requirements.

Another solution which is used is known as "baseless" and has a binding constituted by two separate half-shells which are mutually joined by a rear strap; each half-shell is fixed to the board by screws accommodated in adapted slots formed on the flat part of said half-shells.

Said conventional binding has the drawback that its angular adjustment is limited by the dimensions of the slots.

EPA 96112203.3 in the name of this same Applicant relates to an angular adjustment device, particularly for a snowboard binding to which a disk is rigidly connected to a base for supporting a shoe, which is constituted by engagement means which are associated with the base and selectively interact with grip means formed on the disk.

The disk has a set of teeth which interacts with an additional set of teeth provided in the engagement means, so that the two elements mutually lock through the interaction between the two sets of teeth. Although this solution is valid within the scope of the problem of achieving the angular adjustment of the binding with respect to the board, there could be drawbacks related to possible deformations caused by the continuous use of the device or to accidental impacts or possible temperature changes to which the binding is subjected; all this can alter the operation of the device.

Moreover, the device requires, for its activation, a precise arrangement of the various elements that mutually interact, and this forces the user to make several attempts to achieve the exact position for locking the binding; this might lead, owing to inattention on the part of the user, to possible "false" lockings of the binding, with consequent possible danger for the user safety during sports practice.

SUMMARY OF THE INVENTION

An aim of the present invention is therefore to solve the described problems, eliminating the drawbacks of the cited prior art and providing a device which allows to rapidly achieve an intended and easy angular adjustment of the binding with respect to the longitudinal axis of the board, said adjustment being stable during sports practice, so as to accordingly increase the degree of safety of the user.

A further object is to provide a device in which the angular position assumed by the binding can be locked in an optimum manner and safely without false lockings.

A further object is to provide a device in which the preset adjustment of the angle cannot be modified by the possible presence of snow or water or by any temperature variations.

A further object is to provide a device in which the force which the user can apply to activate the device is low with respect to the perfect locking which can be achieved for the binding.

A further object is to provide a device which allows the user to achieve said intended adjustment very easily and rapidly without requiring him to have particular tools available.

A further object is to provide a device which is structurally compact and unaffected by accidental openings during sports practice.

A further object is to provide a device which allows the user to change the angular adjustment of the binding with respect to the board while keeping the boot associated with the binding and therefore even during sports practice.

A further object is to provide a device which ensures that the binding remains locked to the board during adjustment of the angle, increasing user safety.

Another object is to provide a device whose bulk and weight are negligible for the user during said sports practice.

Another object is to provide a device which is reliable and safe in use and can be manufactured at a low cost by means of conventional machines and equipment.

This aim, these objects, and others which will become apparent hereinafter are achieved by an angular adjustment device, particularly for a snowboard binding which comprises a disk which is rigidly coupled to said snowboard and a supporting base for a shoe, characterized in that it is constituted by first engagement means, associated with said base, which selectively interact, through second release means which can be operated by the user, with third coupling means which are rigidly coupled to said disk.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
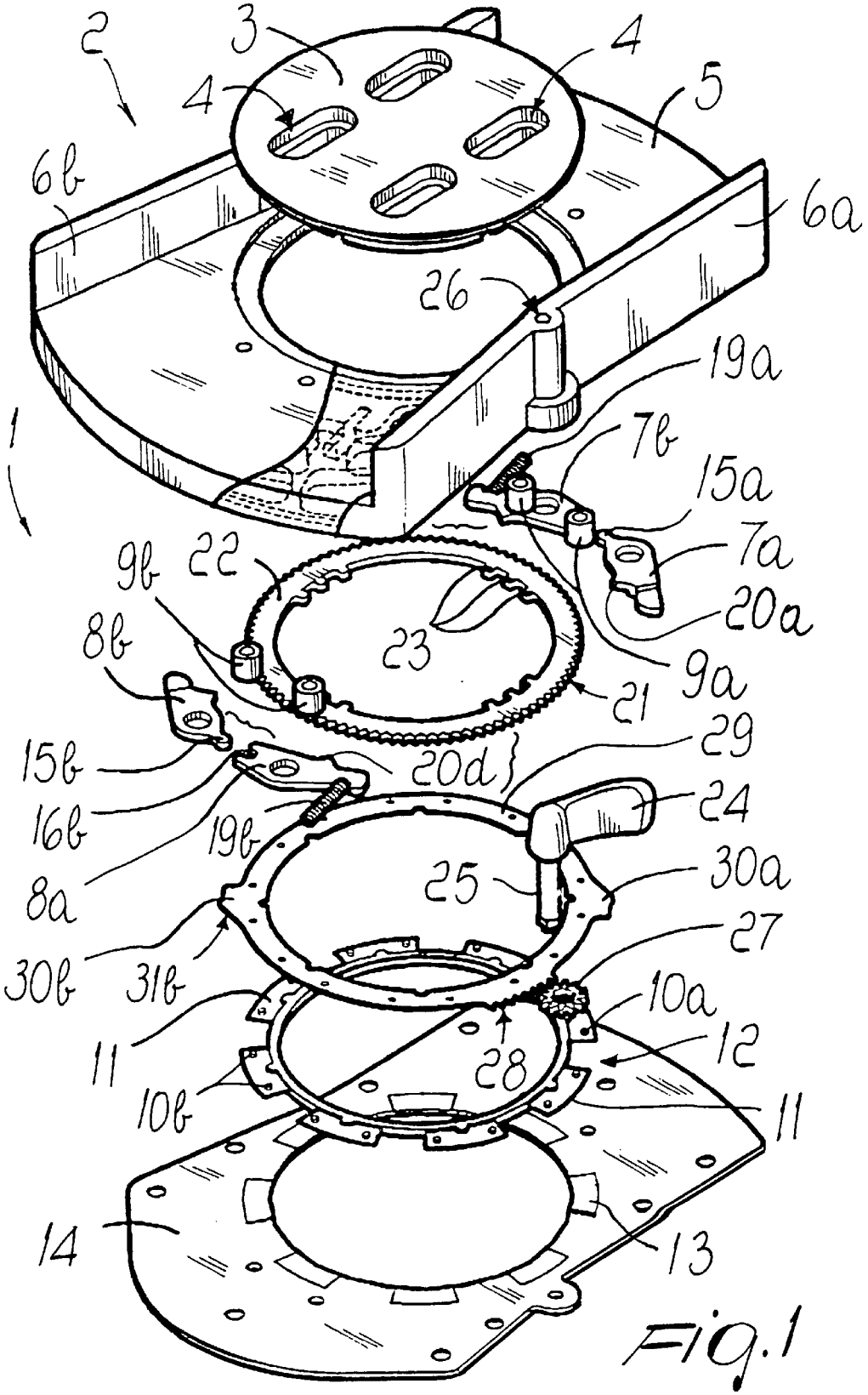
FIG. 1 is an exploded perspective view of the angular adjustment device associated with a snowboard binding.

With reference to the above figures, the reference numeral 1 designates an angular adjustment device, particularly for a snowboard binding 2 which comprises a disk 3 which is rigidly coupled to said snowboard by means of screws which pass through adapted first holes 4 and a base 5 for supporting a shoe which is not shown.

The base 5 is rotatably associated with said disk 3 in a conventional manner and can optionally perform limited vertical movements with respect to the disk by virtue of the optional presence of adapted conventional inclined planes, which are not shown, and protrude from the mutually facing surfaces of the disk base.

Two shoulders 6*a* and 6*b* protrude from the base 5, which is substantially rectangular and has a slightly divergent end, along the longitudinal sides and on the opposite face with respect to the snowboard.

The angular adjustment device comprises first engagement means which are constituted by a first pair of pawls 7*a* and 7*b* and a second pair of pawls 8*a* and 8*b*. Pawls 8*a*, 8*b* are identical and are rotatably associated at adapted sleeves 9*a* and 9*b* which are pivoted at adapted pivots 10*a* and 10*b*. Pivots 10*a*, 10*b* protrude from flaps 11 which are in turn arranged radially with respect to an annular element 12. Flaps 11 are arranged at complementarily shaped first seats 13 formed on a plate 14 which is interposed between the supporting base 5 and the snowboard.

The first and second pairs of pawls are arranged approximately diametrically with respect to the disk 3 and advantageously in a symmetrical fashion with respect to an axis lying transversely to the base 5.

The pawls that constitute each one of said first and second pairs are mutually associated at one end, where one pawl has a first tab, designated by the reference numerals 15*a* and 15*b*, and the other pawl has a complementarily shaped second seat, designated by the reference numerals 16*a* and 16*b*, inside which the first tab is located so that it can slide following a slight rotation imparted to the pawls.

An inclined surface, designated by the reference numerals 17*a* and 17*b*, is formed towards the disk 3 at the free end of one of the pawls that constitute each one of the first and second pairs.

Figure 2:
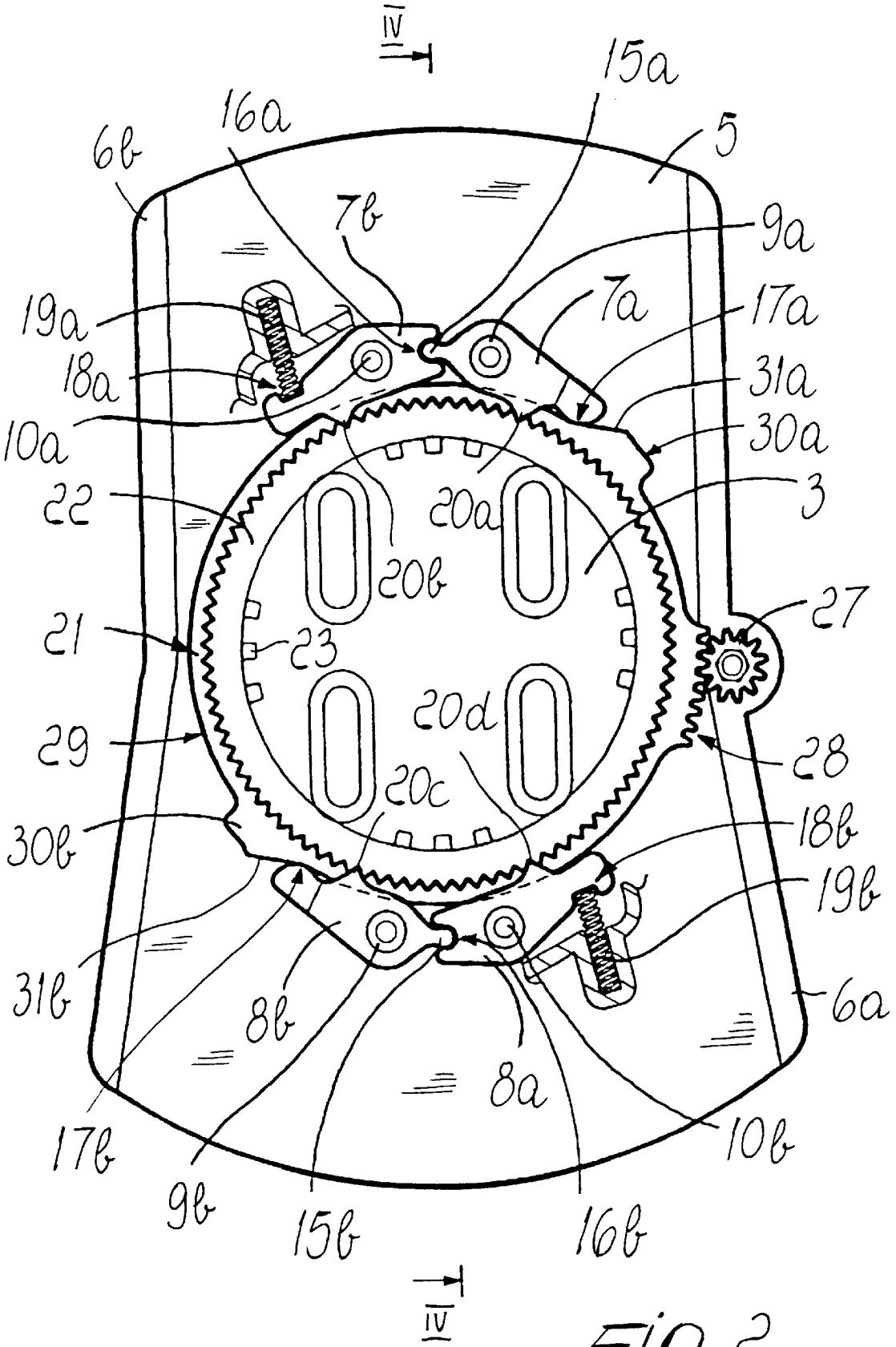
FIG. 2 is a top view of the device in the condition for using the binding.

The inclined surface is formed at the pawls that constitute the first and second pairs, which are arranged in a symmetrical fashion with respect to a median plane lying longitudinally to the base 5, as shown in FIG. 2.

The other one of the pawls that constitute the first and second pairs has, at its free end and on the opposite face with respect to the disk 3, a third seat, designated by the reference numerals 18*a* and 18*b*, for the end of fourth energy accumulation means which are preferably constituted by a spring 19*a* and 19*b* which is associated, at the other end, at an adapted recess formed on the base 5.

Each one of the pawls that constitute the first and second pairs also has, towards the disk 3 and in the interspace between the free end and the sleeves 9*a* and 9*b*, a first tooth, designated by the reference numerals 20*a*, 20*b*, 20*c* and 20*d*. The first teeth 20*c*, 20*d* interact with third coupling means constituted by a first set of teeth 21 which is formed perimetrically and externally with respect to a first ring 22.

The ring is rigidly connected at the disk 3 and has, at its inner perimetric edge, a plurality of second teeth 23 which are arranged at adapted complementarily shaped seats formed below the disk 3.

The angular adjustment device also comprises second means for releasing said first engagement means, said second means being constituted by a lever 24, whose stem 25 is rotatably and freely associated at an adapted fourth seat 26 formed at the shoulder 6*a* of the base 5; the tip of said stem 25 is keyed at a toothed wheel 27 which interacts with a second set of teeth 28 which protrudes radially with respect to a second actuation ring 29, which is rotatably and freely interposed between the first ring 22 and the annular element 12.

Said second release means are also constituted by a pair of second tabs, designated by the reference numerals 30*a* and 30*b*, which protrude diametrically with respect to the second actuation ring 29 and radially with respect to the outer perimetric edge thereof. The second tabs have, on opposite sides, an inclined plane designated by the reference numerals 31*a* and 31*b*.

A rotation imparted to the lever 24 is matched by a rotation applied to the second actuation ring 29, which causes the inclined planes 31*a* and 31*b* of the second tabs 30*a* and 30*b* to interact with the inclined surfaces 17*a* and 17*b* of one of the pawls that constitute said first and second pairs.

Figure 3:
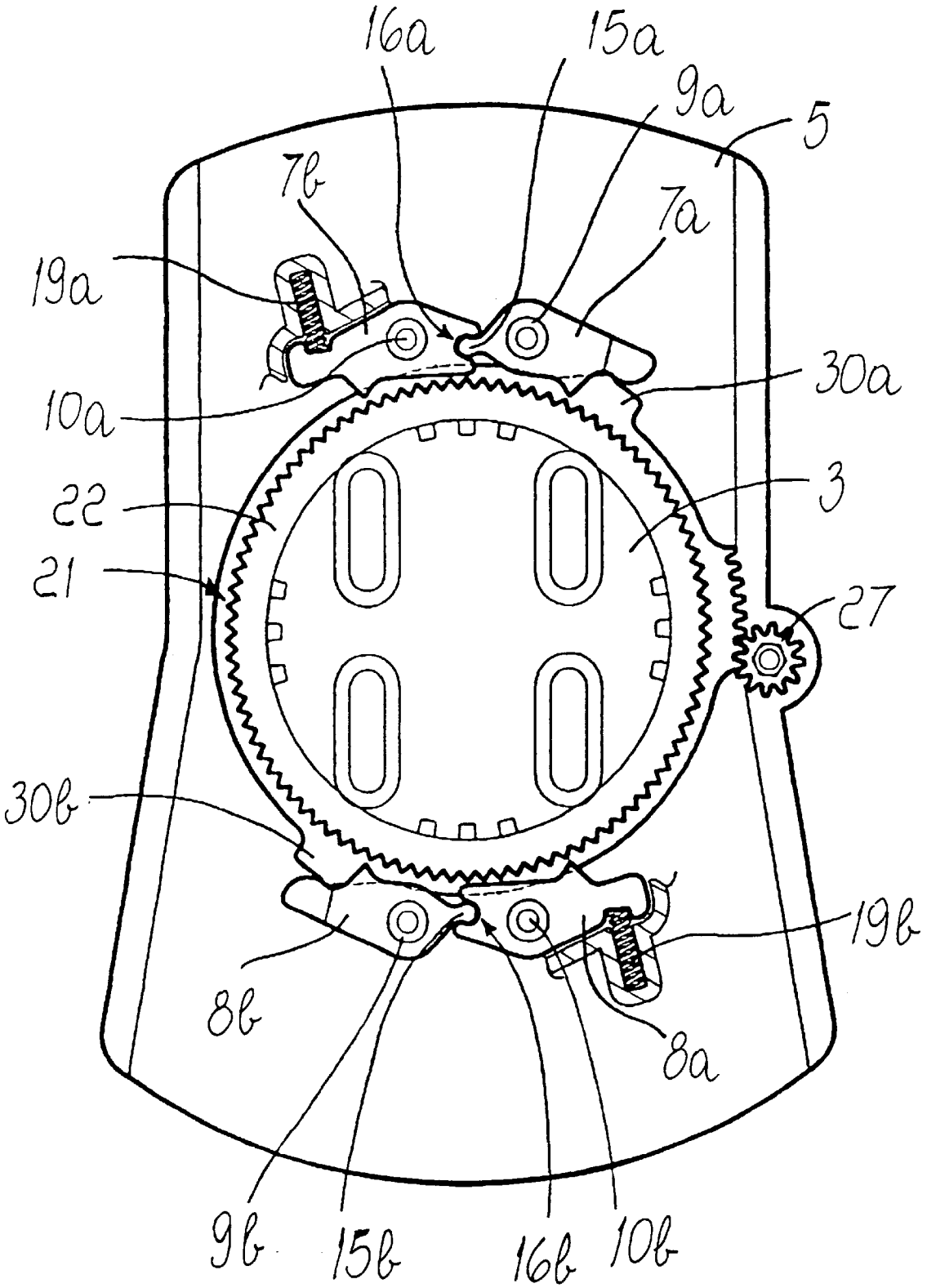
FIG. 3 is a view, similar to FIG. 2, of the device in the released condition for achieving the intended adjustment.
Figure 4:
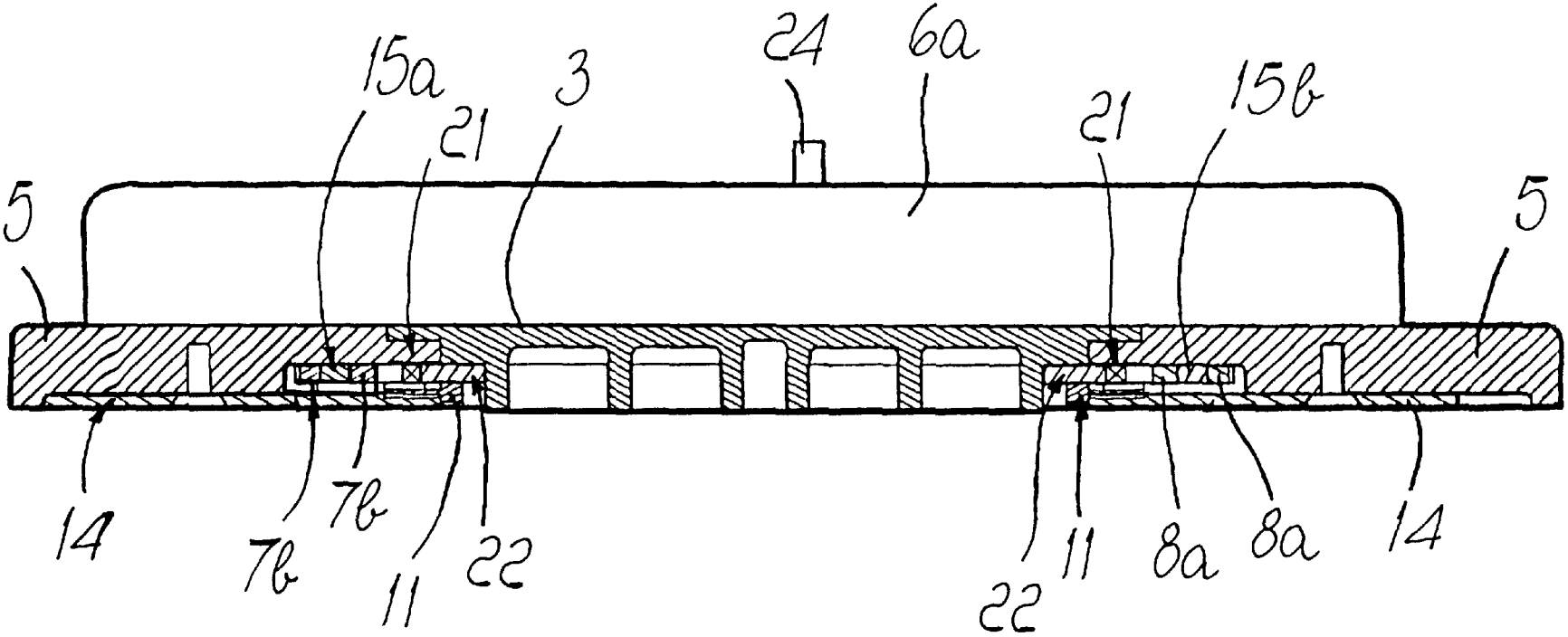
FIG. 4 is a sectional view, taken along the plane IV—IV of FIG. 2.

By doing so, as shown in FIG. 3, the first and second pairs of pawls are rotated until the first teeth 20*a*, 20*b*, 20*c* and 20*d* disengage from the first set of teeth 21 of the first ring 22: in this manner, the first ring, and therefore the disk 3 as well, can rotate freely, thus allowing the skier to preset the intended angle.

Once the desired angle has been set, the user turns the lever 24 in the opposite direction, so as to make the first teeth 20*a*, 20*b*, 20*c* and 20*d* interact again with the first set of teeth 21; the springs 19*a* and 19*b* facilitate such movement.

Because of the mutually opposite position of the pawls that constitute each one of the first and second pairs, and because of the mutual interaction caused by the presence of the first tabs 15*a* and 15*b* which act in the second seats 16*a* and 16*b*, it is possible to securely lock the binding, since any tendency to disengage on the part of one of the pawls constituting the first and second pairs is contrasted by the proportional increase in the force applied to the first ring 22 by the other one of the pawls constituting the first and second pairs.

In fact, regardless of the direction of the rotation to which the binding is subjected, there is in any case an interaction, in the sense of locking, of one pair of the first teeth 20*a*, 20*c* or 20*b*, 20*d* with the first set of teeth 21 of the first ring 22.

The presence of the springs also facilitates the user as regards the force to be applied to the lever 24 to achieve locking.

It has thus been observed that the invention has achieved the intended aim and objects, a device having been provided which allows to rapidly achieve a desired and easy angular adjustment of the binding with respect to the longitudinal axis of the board, said adjustment being optimum, stable and safe during sports practice, thus increasing the safety for the user.

Moreover, the device allows to ensure the locking of the angular position assumed by the binding, the user having to apply a limited force with respect to the perfect locking that can be achieved for the binding.

The device is of course susceptible of numerous modifications and variations, all of which are within the scope of the same inventive concept as claimed.

The materials and the dimensions that constitute the individual components of the device may also be the most pertinent according to the specific requirements.

What is claimed is:

1. An angular adjustment device in a snowboard binding comprising:

a disk rigidly connectable with a snowboard;

a supporting base for a shoe; and engagement means, associated with said base, which selectively interact, through release means which can be operated by the user, with coupling means which are rigidly coupled to said disk;

said engagement means comprising a first pair of pawls and a second pair of pawls both freely rotatably arranged for selective engagement with said coupling means.

2. The combination of claim 1, wherein said first and second pairs of pawls are freely rotatably associated at adapted sleeves which are pivoted at adapted pivots which protrude from flaps which are in turn arranged radially with respect to an annular element, said flaps being arranged at complementarily shaped first seats formed on a plate which is interposable between said base and said snowboard.

3. The combination of claim 2, wherein said first and second pairs of pawls are arranged approximately diametrically with respect to said disk and advantageously in a symmetrical fashion with respect to said annular element.

4. The combination of claim 2, wherein the pawls that constitute each one of said first and second pairs are mutually associated at one end, where one has a first tab and the other one has a complementarily shaped second seat inside which said first tab is arranged, so that it can slide, following a slight rotation imparted to said pawls.

5. The combination of claim 2, wherein an inclined surface is formed towards said disk at the free end of one of said pawls that constitute each one of said first and second pairs, said inclined surface being formed at the pawls of said first and second pairs that are arranged in a symmetrical fashion with respect to a median plane lying longitudinally to said base.

6. The combination of claim 5, wherein the other one of said pawls that constitute each one of said first and second pairs has, at the free end and on the opposite face with respect to said disk, a third seat for the end of energy accumulation means.

7. The combination of claim 6, wherein said energy accumulation means are constituted by a spring which is associated, at its other end, at an adapted recess formed on said base.

8. The combination of claim 2, wherein each one of the pawls that constitute said first and second pairs has, towards said disk and in the interspace between their free end and said sleeves, a first tooth which interacts with said coupling means.

9. The combination of claim 2, wherein said coupling means are constituted by a first set of teeth which is formed perimetrically and externally with respect to a first ring which is rigidly connected at said disk, said first ring having, at the inner perimetric edge, a plurality of second teeth which are arranged at adapted complementarily shaped seats formed below said disk.

10. The combination of claim 9, wherein said release means for releasing said engagement means comprise a lever whose stem is rotatably and freely associated at an adapted fourth seat formed at one of the shoulders that protrude laterally and longitudinally with respect to said base, the tip of said stem being keyed at a toothed wheel which interacts with a second set of teeth which protrudes radially with respect to a second actuation ring which is rotatably and freely interposed between said first ring and said annular element.

11. The combination of claim 10, wherein said release means further comprise a pair of second tabs which protrude diametrically with respect to said second actuation ring and radially with respect to the outer perimetric edge thereof, said second tabs having an inclined plane on opposite sides.

12. The combination of claim 11, wherein said lever is configured such that a rotation imparted to said lever is matched by a rotation imparted to said second actuation ring, which causes said inclined planes of said second tabs to interact with said inclined surfaces of one of the pawls of each one of said first and second pairs, so as to force a rotation of said first and second pairs of pawls so as to disengage said first teeth from said first set of teeth of said first ring, allowing said disk to rotate freely.

13. An angular adjustment device in a snowboard binding comprising:

a disk rigidly connectable with a snowboard:

a supporting base for a shoe; and an engagement device, associated with said base, which selectively interacts, through a release device which can be operated by the user, with a coupling device which is rigidly coupled to said disk;

said engagement device comprising a first pair of pawls and a second pair of pawls both freely rotatably arranged for selective engagement with said coupling device.

* * * * *